US007748239B2

(12) United States Patent
Koenig

(10) Patent No.: US 7,748,239 B2
(45) Date of Patent: Jul. 6, 2010

(54) CIRCULAR KNITTING MACHINE FOR PRODUCING KNITTED FABRICS USING UNTWISTED FIBROUS MATERIAL

(76) Inventor: Reinhard Koenig, Albstrasse 2, 75275 Ettlingen (DE)

( * ) Notice: Subject to any disclaimer, the term of this patent is extended or adjusted under 35 U.S.C. 154(b) by 0 days.

(21) Appl. No.: 12/516,266

(22) PCT Filed: Dec. 3, 2007

(86) PCT No.: PCT/DE2007/002205

§ 371 (c)(1),
(2), (4) Date: May 26, 2009

(87) PCT Pub. No.: WO2008/067804

PCT Pub. Date: Jun. 12, 2008

(65) Prior Publication Data

US 2010/0000263 A1 Jan. 7, 2010

(30) Foreign Application Priority Data

Dec. 3, 2006 (DE) ..... 10 2006 056 895

(51) Int. Cl.
*D04B 9/14* (2006.01)

(52) U.S. Cl. ..... 66/9 B

(58) Field of Classification Search ..... 66/9 R, 66/9 B, 8, 10, 11, 12, 9 A
See application file for complete search history.

(56) References Cited

U.S. PATENT DOCUMENTS

| | | | | |
|---|---|---|---|---|
| 3,019,623 | A * | 2/1962 | Howes | 66/9 B |
| 3,188,834 | A * | 6/1965 | Radtke | 66/9 B |
| 3,896,636 | A * | 7/1975 | Thore | 66/9 B |
| 4,111,006 | A * | 9/1978 | Golladay et al. | 66/9 B |
| 4,345,446 | A * | 8/1982 | Schaberle | 66/9 B |
| 2006/0272357 | A1 | 12/2006 | Koenig | |
| 2009/0064719 | A1 | 3/2009 | Koenig et al. | |

FOREIGN PATENT DOCUMENTS

| | | |
|---|---|---|
| DE | 10 2006 006 502 | 8/2007 |
| WO | 2004/079068 | 9/2004 |

* cited by examiner

*Primary Examiner*—Danny Worrell
(74) *Attorney, Agent, or Firm*—Michael J. Striker

(57) ABSTRACT

A circular knitting machine is described which has a plurality of knitting systems which are arranged on the circumference of the needle cylinder and a corresponding plurality of drawing frames which are assigned individually to the knitting systems for feeding substantially untwisted fibrous materials to knitting tools which can be deployed in the knitting systems into in each case a fibre-receiving position. According to the invention, the drawing frames are configured as miniature bars which have at least four and at most eight adjacent drawing frames and a central housing (25) which is designed to receive the drives and from which the upper and lower rolls (26*b*, 27*b*, 28*b*) of the drawing frame assembly protrude on both sides.

8 Claims, 3 Drawing Sheets

Figure 1:
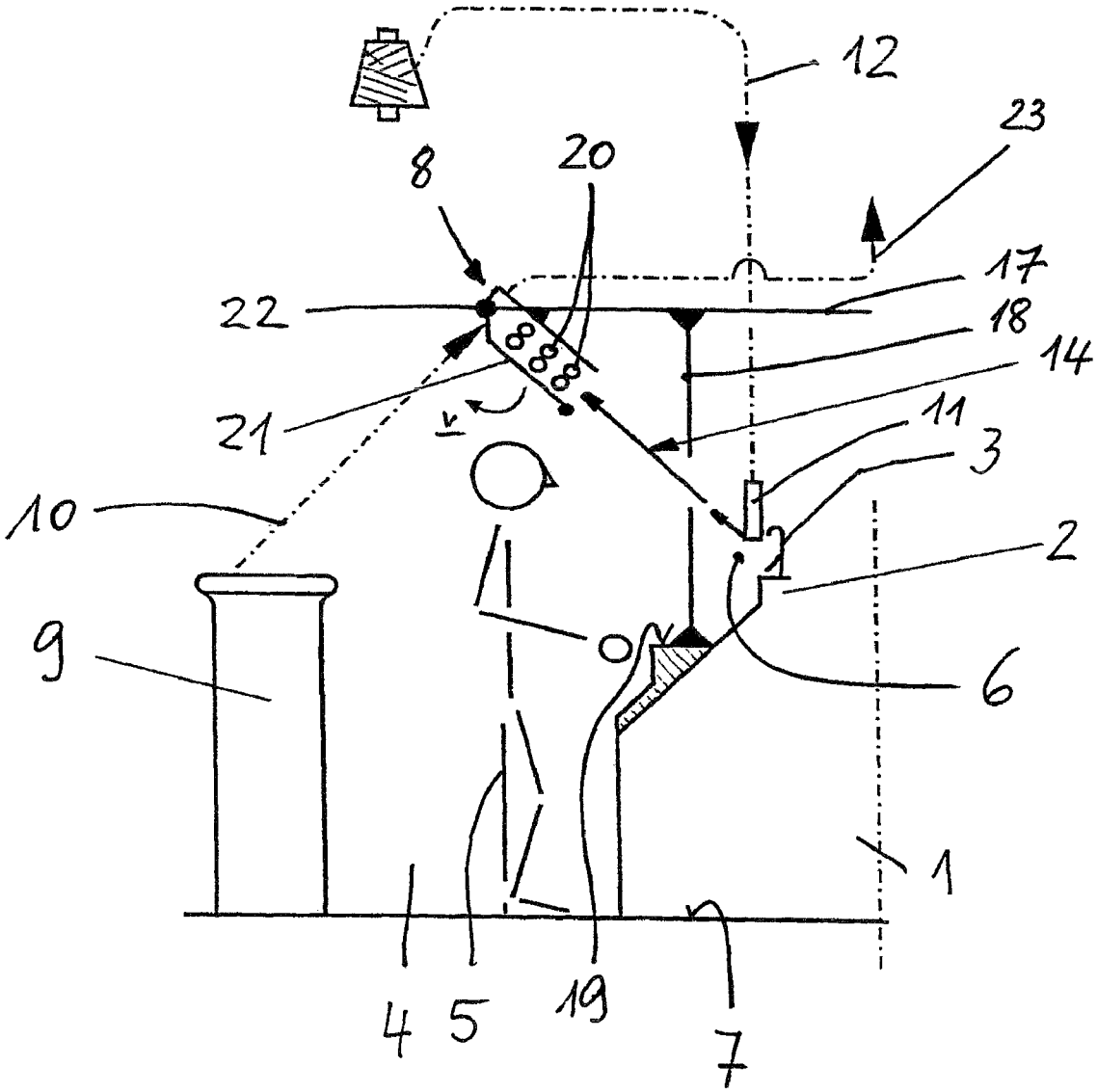

CIRCULAR KNITTING MACHINE FOR PRODUCING KNITTED FABRICS USING UNTWISTED FIBROUS MATERIAL

The invention relates to a circular knitting machine of the type indicated in the preamble of claim 1.

Known circular knitting machines of this type (e.g. PCT WO 2004/079068), termed spinning-knitting machines, are distinguished in that the knitted fabric is produced not from normal, twisted yarns but from a fibrous material which is present as a fibre band, flyer sliver or the like which is formed essentially from untwisted, parallel-disposed staple fibres. This fibrous material is supplied to the knitting systems with the help of drawing frames which are known from spinning technology. As a result, a knitted fabric with extreme softness is obtained.

The drawing frames of the known circular knitting machines which are assigned respectively to one knitting system are combined to form three drawing frame assemblies which are configured in a bar-shape and distributed around the needle cylinder, each drawing frame assembly or bar having a large number of drawing frames and a drive for the rolls thereof. In order to avoid, as a result thereof, too great changes in direction in the thread course and too great differences in the path lengths between the individual drawing frames and the associated knitting systems, comparatively large dead zones are present between the drawing assemblies. A consequence thereof is that only approx. half of the knitting systems of a normal circular knitting machine with a needle cylinder diameter of 30" can in fact be used. Consequently, the advantage that the number of drives required and hence the investment volume can be kept low because of combining a large number of drawing frames to form one drawing frame assembly is at least partially cancelled out again due to the reduced productivity. In addition, the disadvantage exists that the exchange of drawing frame parts, in particular belts provided in the drawing frames is difficult and demands in practice complete dismantling of the drawing frame bar.

In order to avoid these disadvantages, it has already been proposed (DE 10 2006 006 502 A1) to dispose the drawing frames individually and in a segment shape on the circumference of the circular knitting machine. As a result, an individual drawing frame is intended to be assigned either to each knitting system or two drawing frames which are disposed one above the other vertically are intended to form an assembly and operate two adjacent knitting systems. An advantage of this measure resides in the fact that the pressure arms bearing the upper rolls can be pivoted away to the side or downwards. Since however the drawing frames must be operated by drives which are assigned individually to them, a circular knitting machine with 48, 72 or 96 knitting systems requires a considerable number of drives.

Starting therefrom, the object underlying the invention is to propose a compromise between the bar construction and the segment construction, which reduces investment costs and does not make implementation of repair and maintenance operations nevertheless substantially difficult.

The characterising features of patent claim 1 serve to resolve this object.

By means of the invention, the circular knitting machine is surrounded by a comparatively large number of miniature bars which can be connected individually to the circular knitting machine and represent autonomous systems which can be dismantled individually from the circular knitting machine and incorporated again. In order not to impede the continuous knitting process during operations of this type, the circular knitting machine expediently has means in the form of switchable cam parts, electromagnets or the like designed for needle selection in order to be able to switch the knitting systems to non-knitting during operations on the assigned drawing frames.

Further advantageous features of the invention are revealed in the sub-claims.

Figure 2:
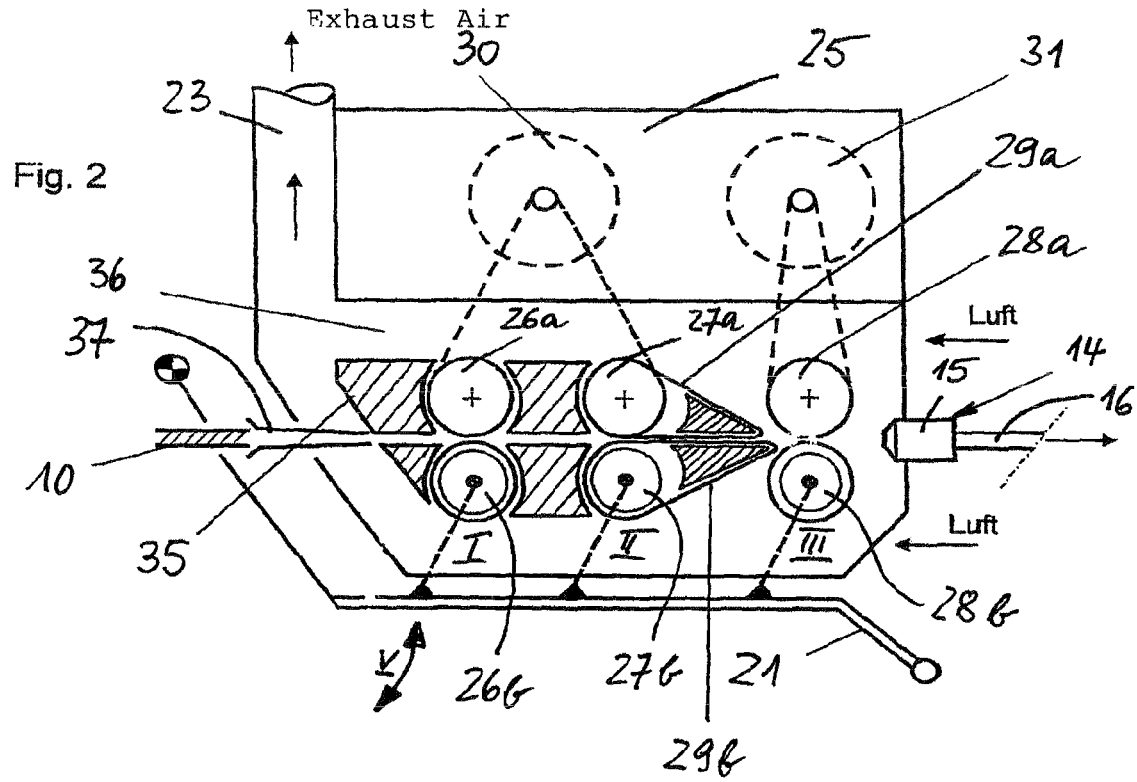
Figure 3:
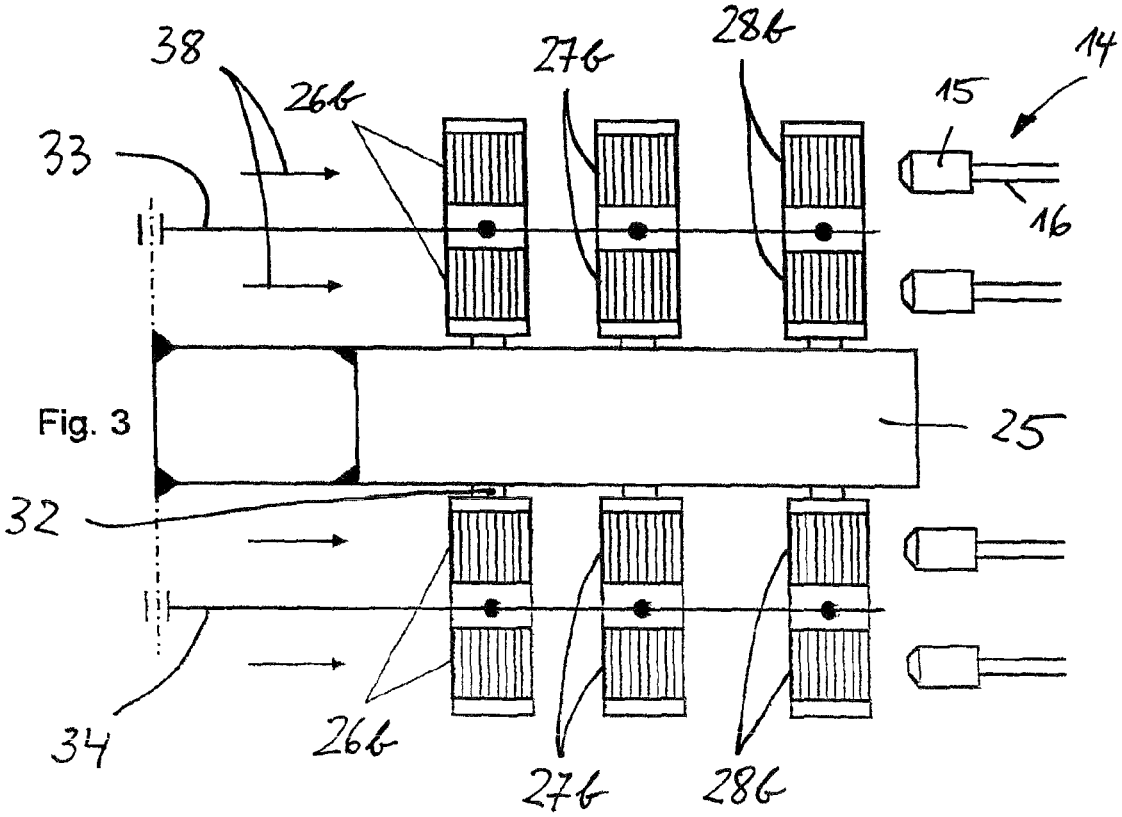

The invention is explained subsequently in more detail by embodiments in conjunction with the accompanying drawings. There are shown:

FIG. 1 schematically, a circular knitting machine according to the invention;

FIG. 2 a cross-section through a drawing frame assembly according to the invention in the form of a miniature bar for four knitting systems, viewed from the side;

FIG. 3 a view from below of the drawing frame assembly according to FIG. 2; and FIGS. 4 and 5 views corresponding to FIG. 3 of drawing frame assemblies for six and eight knitting systems.

FIG. 1 shows schematically a circular knitting machine 1 with a rotatable needle cylinder 2 in which knitting needles 3 are mounted displaceably. In front of the circular knitting machine 1 or in a region surrounding the latter, an operating space 4 is indicated schematically, in which an operator 5 remains during normal operations on the circular knitting machine 1. The height of the circular knitting machine 1 is dimensioned in the normal manner such that a large number of stitch-forming or knitting systems 6, which are formed from cam parts, not represented, and only one of which is shown in FIG. 1, is situated in the handling region of the operator 5. There is understood by the term "handling region" that region which is disposed preferably at a spacing above a floor 7 or the like on which both the circular knitting machine 1 and the operator 5 stands, said spacing being ergonomically particularly convenient and/or prescribed e.g. by operating instructions, standards or in another manner.

The circular knitting machine 1 which is of interest in the scope of the present invention is configured as a so-called spinning-knitting machine. A drawing frame 8 is assigned to each stitch-forming or knitting position 6 and a fibrous material 10 taken from a can 9 in the form of a fibre band is supplied to said drawing frame. Alternatively, the fibrous material 10 can comprise a flyer sliver withdrawn from storage spools. The fibrous material 10 is made finer in the drawing frame 8 in a manner known per se to form a thread and preferably is presented to the knitting needles 3 for stitch-formation by means of a thread guide 11. An auxiliary thread is indicated in addition with the reference number 12 and can be supplied likewise to the thread guide 11.

In addition, between the drawing frame 8 and the thread guide 11, a spinning device 14 which is indicated only schematically in FIG. 1 is preferably disposed, said spinning device containing a twisting member 15 and a spinning or transport tube 16 (cf. also FIG. 2) for the fibrous material 10.

Circular knitting machines of the described type are known to the person skilled in the art for example from the initially mentioned publication PCT WO 2004/079068 A2 which, in order to avoid repetitions is herewith made the subject of the present disclosure by reference thereto.

In a preferred embodiment of the invention, the drawing frames 8 are disposed such that they are situated, like the knitting systems 6, in the handling region of the operator 5 working at the circular knitting machine 1. For this purpose, the drawing frames 8 are mounted for example on a bearing ring 17 which is supported by means of columns 18 on a base or cam plate 19 of the circular knitting machine 1. The arrangement is particularly advantageous in addition such that the nip lines formed by three or more pairs of drawing rolls 20 or the like are situated not in horizontal planes but in inclined planes corresponding to FIG. 1, pairs of input rolls orientated towards the respective cans 9 being situated higher than the pairs of output rolls orientated towards the circular knitting machine 1 above the floor 7.

The embodiment according to FIG. 1 is distinguished in that the axes of the drawing rolls 20 are all disposed horizontally in the state of use. In order to achieve that the drawing frames 8 can not only be reached by the operator 5 from the operating space 4 but can also be maintained and/or repaired easily without them requiring to be dismantled completely, the drawing frames 8 can be opened at least partially as a result of the fact that their essential functional parts, according to the invention, are mounted at least partially pivotable downwards in the drawing frames 8. This is indicated in FIG. 1 by a component carrying the so-called upper rolls in the form of a pressure arm 21 which, in contrast to conventional technology, is situated below instead of above and can be pivoted in the direction of an arrow y about a horizontal pivot axis 22 which is indicated by way of example. As a result, the rolls of a selected drawing frame 8 are made accessible if required so that belts present on these can be exchanged, fibre agglomerations present in the drawing frame 8 can be removed and other operations can be implemented without the operator 5 requiring to leave his operating space 4.

The drawing frame 8 is connected preferably to a suction device 23 which is able to collect dirt and airborne fibres.

A plurality of drawing frame assemblies is disposed at the circumference of the needle cylinder 2, said assemblies having a number of drawing frames, corresponding to the number of knitting systems 6, for respectively one of the fibrous materials 10. As explained further on, the drawing frame assemblies are configured as so-called miniature bars, each drawing frame assembly or miniature bar combining at least four and at most eight drawing frames to form an autonomous assembly. If a circular knitting machine 1 with a needle cylinder diameter of 30" and 48 knitting systems 6 is of concern, then in total twelve miniature bars are required in the case of e.g. four drawing frames per miniature bar. For technological knitting reasons, the number of knitting systems 6 is expediently a number which is divisible by three or four and the number of drawing frames per miniature bar should likewise be divisible by three or four.

Furthermore, the total width of such a miniature bar is important. The total width should be as small as possible in order that the distance from the exit of the fibrous material flow from a drawing frame up to the entry thereof into a knitting system 6 is as small as possible. This condition results from the function of the spinning device 14.

FIGS. 2 and 3 show the basic construction of an embodiment of a drawing frame assembly in the form of a miniature bar according to the invention, which is regarded at present as the best. The drawing frame assembly contains a central housing 25 in which transmissions and drives for pairs of drawing frame rolls are accommodated. In the embodiment, the drawing frames are configured as 3-roll drawing frames which have respectively one pair of input rolls I, central rolls II and output rolls III, the central roll pair I being configured expediently as double-belt assembly and being provided with belts 29*a* and 29*b*. Consequently, each pair of rolls I to III has a roll 26*a*, 27*a*, 28*a* situated at the top and a roll 26*b*, 27*b*, 28*b* situated at the bottom. In contrast to conventional drawing frames, the upper rolls 26*a*, 27*a* and 28*a* are connected to schematically indicated drives 30 and 31 configured for example as servomotors which serve for production of a preliminary drawing between the pairs of rolls I and II and a main drawing between the pairs of roll II and III. The drives 30, 31 are accommodated together with the required transmission parts in the housing 25 and drive shafts which protrude through the housing 25 and protrude out of the housing 25 on both sides. In FIG. 3 which shows a schematic outline, this is indicated for a shaft 32, specific individual parts not being represented for the sake of clarity. The rolls 26*a* to 28*a* are mounted on these shafts 32. As alternative, the rolls 26*a* to 28*a* can also be formed by portions formed on the shafts 32, in which case it would be possible to talk about drawing positions or drawing tracks instead of individual drawing frames. However the normal terms "drawing frames" and "rolls" are retained in the subsequent description.

As FIG. 3 shows, the shafts 32 protrude out of the housing 25 on both sides, said shafts being provided on each side with two input, central and output rolls 26*a* to 28*a* situated at the top. All the shafts 32 are disposed horizontally in the mounted state of the miniature bar (FIG. 1). The lower rolls 26*b* to 28*b* are mounted rotatably in contrast on pressure arms 33 and 34 which are mounted pivotably on the housing 25 about axes 34 parallel to the shafts 32. The pressure arm 33 is disposed on the one side and the pressure arm 34 on the other side of the housing 25. Both pressure arms 33 and 34 hence carry respectively two coaxial rolls 26*b*, 27*b* and 28*b* and can be pivoted downwards in the direction of the arrow v in order to exchange for example the belts 29*a* and/or 29*b* of the upper and/or lower rolls 27*a*, 27*b* or to implement other repair or maintenance operations.

Furthermore, known filling pieces 35, suction and blowing channels 36 and input funnels 27 complete the 3-roll drawing frames. Consequently, each drawing frame transports a fibrous material flow, indicated by an arrow 38 (FIG. 3), in the direction of the associated spinning device 14.

A drawing frame assembly or miniature bar configured in this manner represents an autonomous unit. If a miniature bar is exchanged or stopped because no fibrous material 10 is present or another disruption occurs then the associated knitting systems can be stopped in that they are switched to non-knitting. This switch-over can be effected by an operator with the help of an automatically operating thread monitor or otherwise. It is consequently possible to stop the entire miniature bar and the associated knitting systems 6 temporarily from functioning without requiring to interrupt the continuous stitch-forming process on the circular knitting machine 1.

The miniature bar according to FIGS. 2 and 3 is used preferably for circular knitting machines with 48 knitting systems 6. The width thereof can be adjusted in this case for example to approx. 20 cm to 25 cm and, particularly advantageously, to approx. 22 cm, as a result of which it is possible to provide sufficiently short spinning devices 14, which is expedient for stabilising the spinning process.

Figure 4:
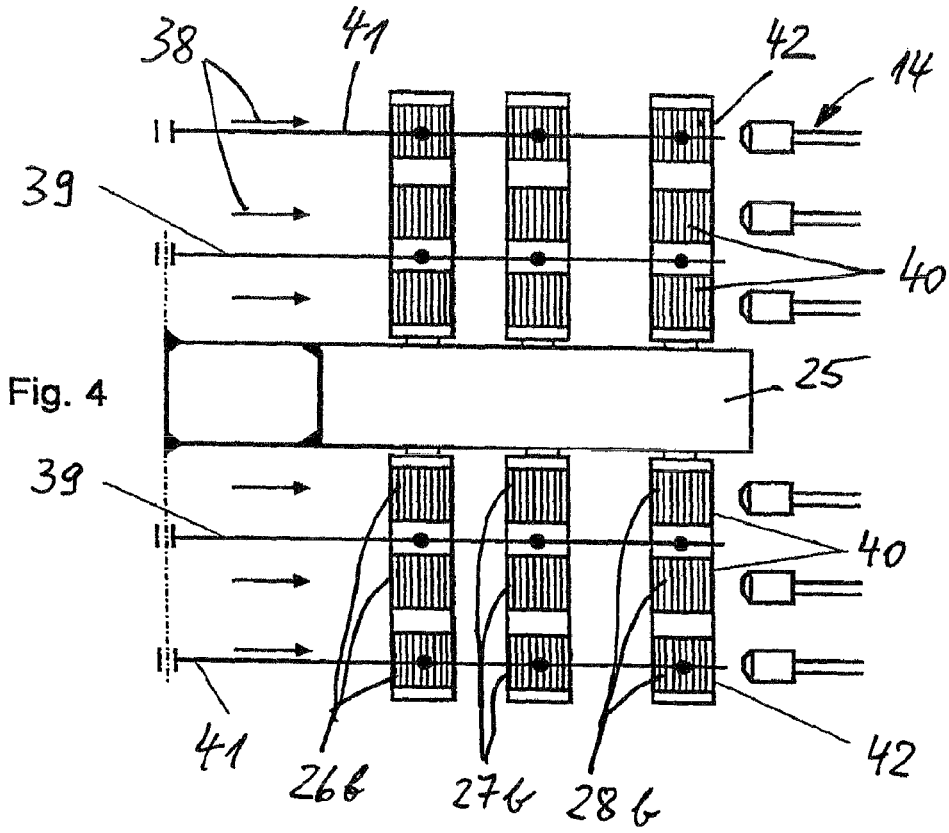

FIG. 4 shows a miniature bar with six drawing frames or drawing positions, the fibrous material flows being indicated in turn by the arrows 38. In contrast to FIG. 3, respectively three rolls are disposed here on each side of the housing 25. In addition, there is disposed on each side of the housing 26 respectively a first pressure arm 39, which carries respectively two rolls 26*b*, 27*b* and 28*b* and hence is responsible for drawing two adjacent fibrous material flows 40, and a second pressure arm 41 which carries the remaining rolls 26*b*, 27*b* and 28*b* and hence ensures the drawing of the respectively remaining third fibrous material flow 42.

Figure 5:
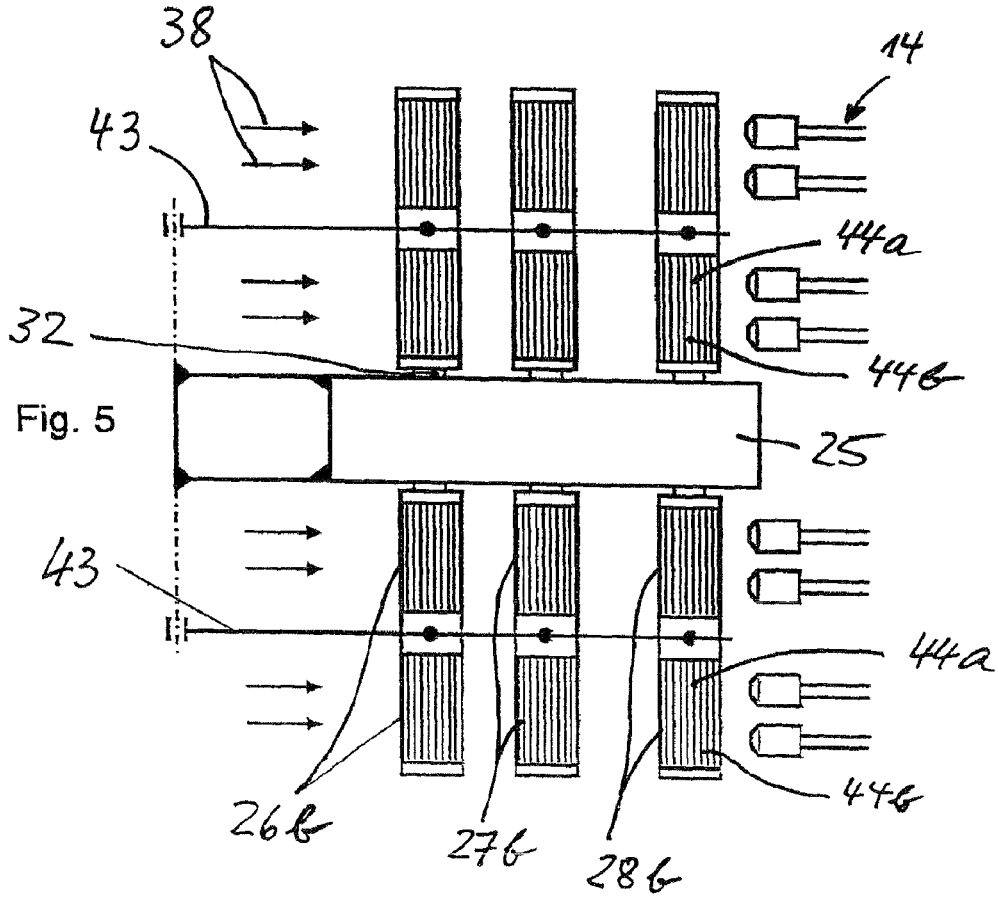

The miniature bar according to FIG. 5 can be produced with a total width of 25 cm. It is suitable for example for circular knitting machines 1 with a needle cylinder diameter of 30" and 72 knitting systems for which then in total twelve miniature bars are in turn required.

FIG. 5 shows a miniature bar with eight drawing frames or drawing positions for eight fibrous material flows (arrows 38). On both sides of the housing 25, the shafts 32 are provided here with respectively four coaxial rolls 26*a*, 27*a* and 28*a* which are not visible in FIG. 5. In addition, there is present on both sides of the housing 25 respectively one pressure arm 43 which is responsible for all four fibrous material flows of the relevant side and the rolls 26*b*, 27*b* and 28*b* assigned thereto. As FIG. 5 shows, it can be particularly expedient in this embodiment to draw respectively two adjacent fibrous material flows with rolls 26 to 28 which have two adjacent tracks 44*a*, 44*b* on the same portion of the circumference.

The width of the miniature bar according to FIG. 5 can be adjusted to approx. 25 cm. This miniature bar is therefore suitable e.g. for circular knitting machines 1 with needle cylinder diameters of 30" and 96 knitting systems 6 so that, here also, twelve miniature bars are used.

The invention is not restricted to the described embodiments which can be modified in many ways. This applies in particular to the indicated dimensions which can also be chosen to be different according to requirements. In addition, it is clear that the drawing frame assemblies (miniature bars) can be provided in addition with all the required components which are present normally in drawing frames and not shown in the representation for the sake of simplification. Finally it is understood the different features can also be applied in combinations other than those described and represented.

The invention claimed is:

1. Circular knitting machine, containing: a rotatably mounted needle cylinder (2), knitting tools (3) disposed therein, a plurality of knitting systems (6) disposed on the circumference of the needle cylinder (2) and a corresponding plurality of drawing frames (8) assigned individually to the knitting systems (6) for supplying essentially untwisted fibrous materials (10) to knitting tools (3) which can be deployed on the knitting systems (6) in respectively one fibre-receiving position, the drawing frames (8) having upper and lower rolls (26*a*, 27*a*, 28*a*; 26*b*, 27*b*, 28*b*) and being combined in bar form to form drawing frame assemblies which are provided with common drives and disposed distributed on the circumference of the needle cylinder (2), characterised in that each drawing frame assembly has at least four and at most eight adjacent drawing frames and a central housing (25) intended for receiving the drives (30, 31), from which housing the upper and lower rolls (26*a*, 27*a*, 28*a*; 26*b*, 27*b*, 28*b*) of the drawing frame assembly protrude on both sides.

2. Circular knitting machine according to claim 1, characterised in that the drawing frames (8) comprise 3-roll drawing frames which have respectively one pair of input, central and output rolls (I, II, III) which are mounted respectively coaxially to each other on the housing (25).

3. Circular knitting machine according to claim 2, characterised in that the input, central and output rolls (I, II, III) are provided on respectively one common shaft (32) which penetrates the housing (25).

4. Circular knitting machine according to claim 1, characterised in that rolls (26*a*, 27*a*, 28*a*) connected to the drives (30, 31) are situated at the top and rolls (26*b*, 27*b*, 28*b*) situated at the bottom are mounted on pressure arms (21, 33, 34, 39, 41, 43) which are connected to the housing (25) pivotably downwards.

5. Circular knitting machine according to claim 4, characterised in that respectively one pressure arm (33, 34; 43) is provided on both sides of the housing (25).

6. Circular knitting machine according to claim 1, characterised in that respectively the rolls for two or four drawing frames are provided on both sides of the housing (25).

7. Circular knitting machine according to claim 4, characterised in that respectively the rolls for three drawing frames are provided on both sides of the housing (25), there being mounted pivotably on each side a first pressure arm (39) for respectively two drawing frames and a second pressure arm (41) for respectively one drawing frame.

8. Circular knitting machine according to claim 1, characterised in that it is provided with means for switching the knitting systems (6) to non-knitting.

* * * * *